United States Patent [19]

Bigliardi

[11] Patent Number: 4,577,772

[45] Date of Patent: Mar. 25, 1986

[54] COLLAPSIBLE CONTAINERS

[76] Inventor: Juan B. Bigliardi, Sante Fe 3735 4th Floor "A", 1425 Buenos Aires, Argentina

[21] Appl. No.: 697,515

[22] Filed: Mar. 26, 1985

[51] Int. Cl.[4] ..... B65D 7/26

[52] U.S. Cl. ..... 220/1.5; 220/4 F; 220/334

[58] Field of Search ..... 220/1.5, 4 F, 334

[56] References Cited

U.S. PATENT DOCUMENTS

| | | | |
|---|---|---|---|
| 3,570,698 | 3/1971 | Dougherty | 220/1.5 |
| 3,612,330 | 10/1971 | Baer | 220/1.5 |
| 3,796,342 | 3/1974 | Sanders, et al. | 220/1.5 X |
| 4,214,669 | 7/1980 | McQuiston | 220/1.5 X |

*Primary Examiner*—Steven M. Pollard

*Attorney, Agent, or Firm*—Anthony A. O'Brien

[57] ABSTRACT

A container includes opposite sidewalls each comprising a medial hinge joining two panels to permit inward folding of the sidewalls with simultaneous collapsing of the top and bottom sections which are pivotally attached to respective edges of the sidewalls this pivotal attachment is provided by hinge assemblies including cooperating U-shaped plates shiftable to allow both maintenance of a rigid expanded container and also permit the collapse thereof. End door members include pivotal attachment devices which may include roller elements to allow displacement of the end door members from an end closing position to a position disposed parallel with and underlying the top section.

7 Claims, 20 Drawing Figures

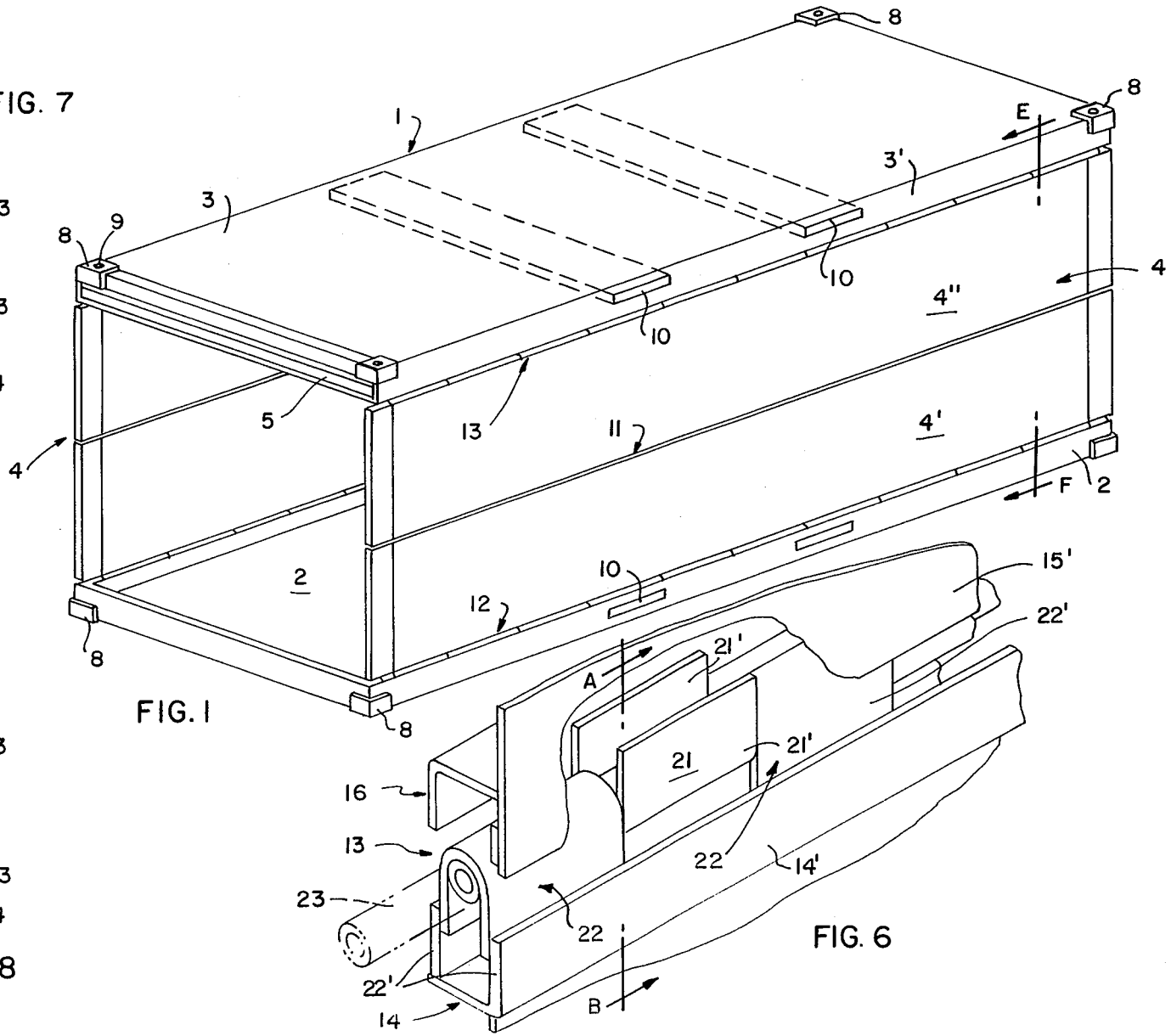
FIG. 1
FIG. 6
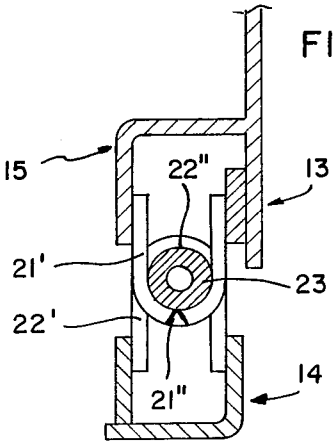
FIG. 7
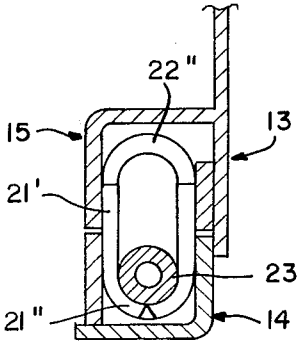
FIG. 8

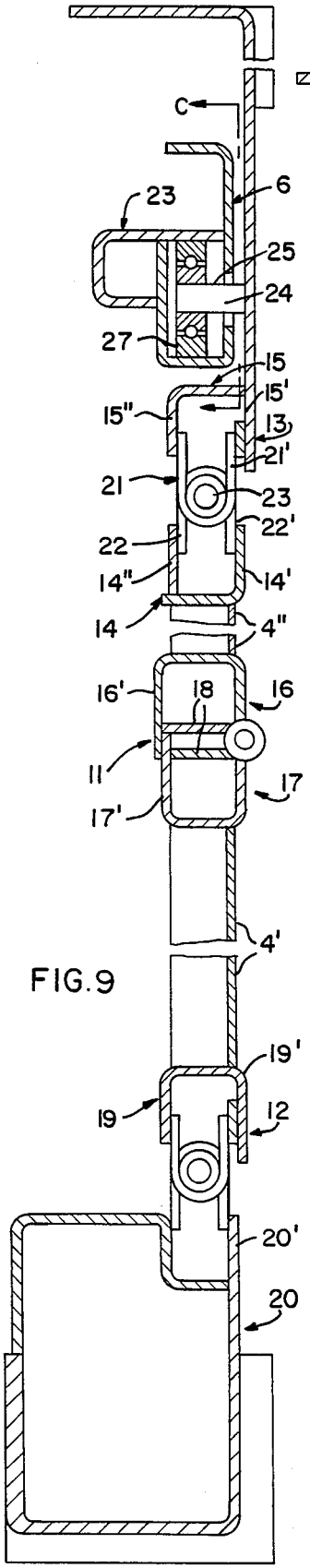
FIG. 9
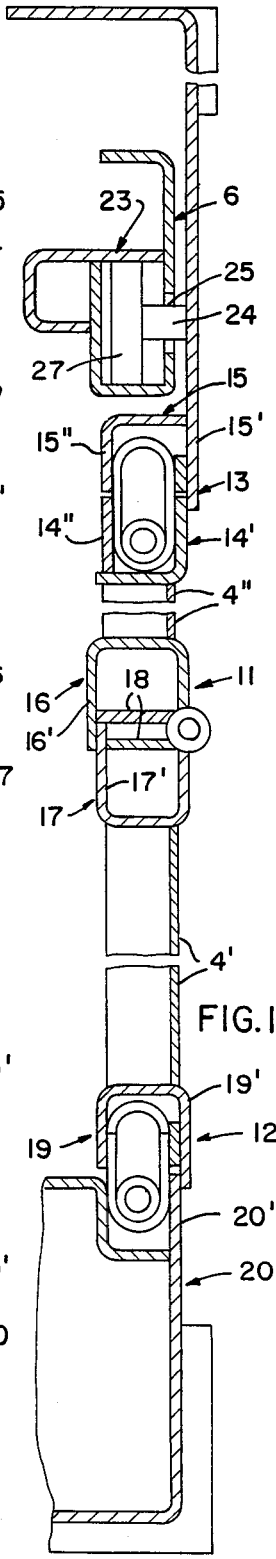
FIG. 10
FIG. 11
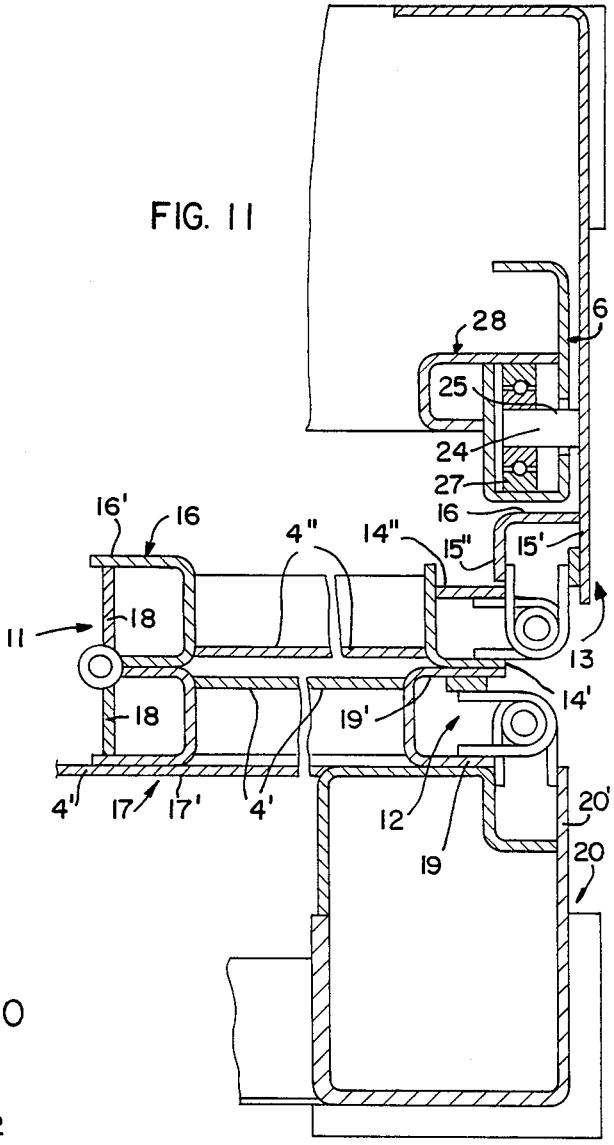
FIG. 12
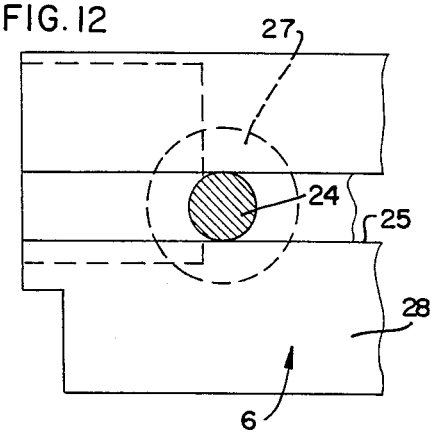

COLLAPSIBLE CONTAINERS

The present invention relates to containers for the transport of cargo and, more specifically, to an improved collapsible container for the transport of general cargo.

Large-capacity containers are used for easy transfer of goods and cargo from one transporting vehicle to another or for shipping cargo overseas or overland.

Containers have been universally adopted for the transportation of cargo because this form of shipment has eliminated the need for transferring the cargo manually or by conventional means from one vehicle to another during the transport to a certain destination.

The containers used in the majority of countries have been standardized in regard to their dimensions and structures so that they are adapted to various means of transportation. Furthermore, in this way the space available in holds or on deck of ships transporting the containers is used in an optimal manner.

Both the dimensions and structural features of the containers have provided a substantial reduction of the space required and have offered advantages of transport since, when properly accommodated, the cargo does not experience any detrimental effects from handling as in the usual transfer operations in cargo transport.

The main disadvantage of conventional containers which are formed by a rigid prismatic structure results from the fact that after use and delivery, the empty containers must be transported from their destination to a point of loading from where they are shipped back to points of re-use.

These operations are economically disadvantageous because the empty container, which is a rigid structure, occupies in the transporting means a space which otherwise could be occupied by containers with cargo.

Handling the container and putting it back on ship imply a number of problems, particularly in the case of ships, since the empty containers must be arranged in a very peculiar manner among themselves and in relation to containers with cargo. The total freight of the ship must be properly balanced and centered to obtain the required safety of the ship on its trip.

Certain means of transportation therefore often carry empty containers which cause important losses to be considered in advance.

In order to eliminate these disadvantages resulting from the use of rigid-structure, prismatic containers, containers with collapsible structure components have been designed and built. In such containers the walls can be folded onto the base so that after discharge of the cargo, the empty container will occupy less space in the collapsed state for transport.

Containers of this type must be handled carefully at the points of loading and unloading since the design features do not allow the usual rough treatment of containers with rigid structure.

Containers with such pivotable walls help to reduce the space required by them but have certain features which make their use incompatible with the use of standardized containers since the handling of such containers requires different equipment not suitable for standard containers.

Containers with folding walls usually comprise reinforcing or retaining members of the walls. These members may get lost and therefore may cause serious inconvenience in the assembly or unloading of such containers with complicated structure elements.

In certain countries one uses prismatic containers with pivotable head members or doors arranged on the container floor or the base and hinged to sidewalls attached to the base or to the roof of the container. Each of the sidewalls is provided with hinge lines allowing the folding of portions of the sidewalls into the interior of the container in the form of bellows. The doors or head members of the container form a reinforcing frame in the assembled state of the container. The various hinged components can be connected on that frame and are finally affixed to it by locking members so that a hollow body meeting all standard requirements is obtained.

Collapsible containers of this type are a solution to the problem of dead space occupied once the cargo has been delivered since in the collapsed state, the height of the containers is substantially reduced and at least four collapsible containers can be transported in place of one rigid container.

Collapsible containers of the type described exhibit certain functional shortcomings since the folding or pivoting of the elements is not adequately safe and correct.

Folding the door sections or head members onto the floor section requires a structure of peculiar design since a loss of space results from positioning the door members on the floor section. Such a loss of space should be avoided.

Furthermore, the sidewalls are usually hinged with "piano type" hinges which are not very efficient because they cause frequent failures during the use of the container and require a special design at the hinge joints of the sidewalls to incorporate sealing members. The various elements of the container structure must provide sealing so that there arises the need for joints or packings which retain their efficient functioning during assembly and folding of the container.

When special designs are incorporated in the hinge joints to prevent the entry of foreign material, it is hard to obtain the required sealing effect because in prolonged use of the containers, a number of problems develop at the hinge joints. The problems and failures cause additional expenses with the resulting disadvantages in the handling of this type of cargo containers.

The goal of the present invention is to provide a container with collapsible sidewalls and a number of novel improvements to overcome the above-listed disadvantages, with the container of the invention being compatible with standard containers so that the combined utilization of the containers is possible without need for special hoisting means.

The present invention therefore provides a container without elements and components which may cause inconvenience in the assembly of the container, which means that the container of the invention can be more easily assembled.

The proposed container comprises door members adapted to rotate on pivots integral with the sidewalls in the area corresponding to the top section or the upper base of the container. In this way, the folding of the sidewalls is facilitated and the sidewalls may be provided with hinges to collapse the container when it is without cargo.

In a first embodiment of the invention, the door members can be retracted into the top section and are for this purpose provided with guide means configured to pivot from the outside of the container and to slide into the interior of the top section.

In a second embodiment of the invention, the door members or head sections hinged to said pivot means can be withdrawn toward the inside of the container until they abut the top section to allow the folding of the container sidewalls.

Positioning the door members close to the top section reduces the height of the collapsed container and implies a reduction of space vis-a-vis containers having door members folded onto the floor section of the container.

Other advantages of the invention result from the use of hinge members of the sidewalls vis-a-vis the top section and floor section. The characteristic features of these hinge members allow efficient pivoting of the same without need for "piano type" hinges which during prolonged use deteriorate and do not provide the hermetic sealing and the rigidity of the hinge members used in the present invention.

In the container of the invention, the sidewalls which are formed by two hinged portions in a known manner are joined to the floor section and the top section through hinge members formed by a pair of U-shaped plates which, in turn, are connected to the top section and the floor section. One of the pair of plates is interconnected by a hinge shaft whereas the other one is free with respect to said shaft so that, while the container is being assembled, the plates with the hinge members are shifted to form a profiled enclosure of the sidewalls in both the floor section and the top section. In this way the rigidity of the structure in the assembled state is enhanced. When in the collapsed state the top section is lifted, the sets of plates leave the enclosing position and liberate the side walls for unfolding.

It is therefore another characteristic feature of the invention that, for unlocking the sidewalls, the top section must be lifted so that the U-shaped plates are separated from the enclosure and the sidewalls can be unfolded after retracting the door members of the container toward the top section.

This operation can be performed with cranes or equivalent conventional equipment gripping the top section at its edges or by using a crane with claws which can be introduced into transverse channels or slots provided for this purpose in the top section of the container.

Another goal of the present invention is to incorporate locking members of the door members to obtain locking at the floor and the top sections or of the sidewalls with respect to the latter. Once the container has been assembled and loaded, its structure is therefore rigid during the handling and transport of the container.

The invention provides for this purpose locking means comprising fixed elements in the profiles integral with the top section and the floor section and movable elements actuated by lever means attached to the retractable walls of the container. The locking members increase their pressure when the forces on the entire structure increase and provide in this way stability and safety previously not obtained with conventional collapsible containers.

The locking members contribute to the absorption of stress forces to which the hinges formed by the movable plates may be subjected, with the plates not being able to transmit the stress.

In another feature of the invention, the enclosing profiles of the hinge means comprise flaps which overlap in the assembled state of the container and therefore guarantee its rigidity and, in some cases, make the introduction of an additional joint unnecessary.

In other cases, the introduction of an additional joint can increase the structural safety.

The present invention therefore provides improvements on a collapsible container comprising a box-like prismatic structure formed by a floor section, a top section, a pair of sidewalls connected by hinge means to said floor section and said top section along a median line to define portions of equal surface area in said sidewalls, said portions adapted to be folded onto themselves and toward the interior of the container, with the ends of the structure being closed by door members or head sections pivotably mounted and adapted to be folded back toward the interior of the container, with said top section and said floor section comprising a profiled frame with generally prismatic corner brackets forming means for engaging means for hoisting the container, with the container walls provided with cooperating locking members to rigidly maintain the walls in the assembled position, with the container characterized in that said door members or head sections are mounted so that they can pivot toward the top section of the structure through coaxially disposed pivots, that the hinge members of the sidewalls engaging the floor section and the top section, respectively, are formed by a pair of U-shaped oppositely directed plates, that the legs of the plates of one of the pairs are integral with the hinge means rigidly connected to the legs of a U-shaped profile forming part of the sidewalls, whereas the legs of the plates of the other pair in form of a U-shaped profile are integral with said top section, that a set of U-shaped plates of the hinge means is rigidly connected to a hinge line extending across the U-shaped plates of the other set and are adapted to be freely moved with respect to the hinge axis, that the intermediate portions of said U-shaped plate form an enclosure of the hinge means in said U-shaped profiles integral with the sidewalls and the top section in the assembled state of the container, that the plates of the two sets remain connected and pivotable around said axis in a second, collapsed state of the container, and that the frames forming the floor section and the top section are provided with supports of corresponding protruding locking means extending from the frames of said sidewalls and from the door members of the container.

The invention also relates to other goals which will be understood from the description given below.

For the purpose of obtaining full understanding and for facilitating the practicing of the present invention, one of the preferred embodiments is shown in the appended drawings.

FIG. 1 is a perspective view of a collapsible container with the improvements provided by the present invention and shows a door member retracted toward the top section or roof and the structure of the container in an intermediate position, i.e., with the top section raised to allow the unlocking of the container components.

FIG. 6 is a perspective view of the hinge means connecting the sidewalls with the floor section and the top section and forming one of the characteristic features of the present invention.

FIGS. 7 and 8 are views along line A-B of FIG. 6 and show the hinge means of FIG. 6 in the two operational positions, unlocked in FIG. 7 for folding, and in the engaged in FIG. 8 for obtaining maximum rigidity of the container structure.

FIGS. 9 and 10 are views along line E-F of FIG. 1 and show elements integral with the sidewalls, the top section, and the door member or end portion of the container in positions before the assembly of the container.

FIG. 11 is a section illustrating the sidewall retracted with respect to the floor section and the top section.

FIG. 12 is a detail of the section along line C-D and shows one end of the door member with a stop at the pivot.

Figure 17:
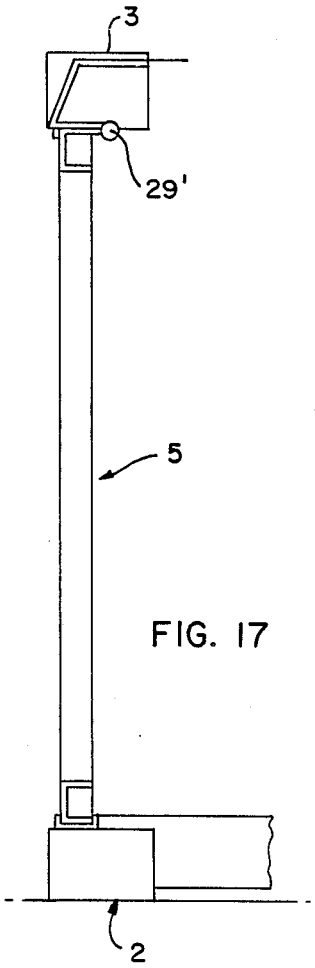
Figure 18:
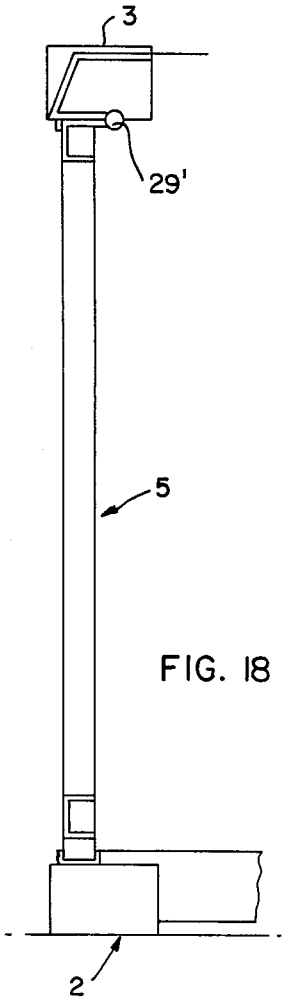
Figure 19:
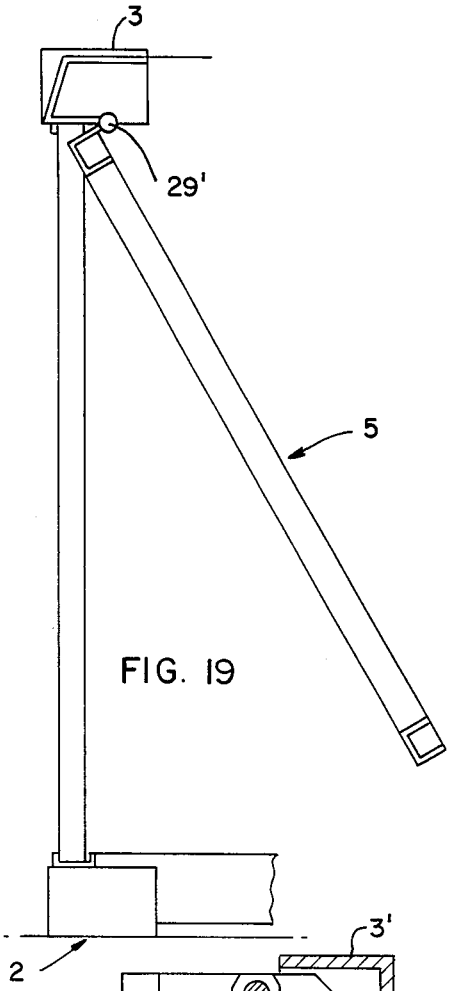

FIGS. 17, 18, and 19 show another embodiment of the door members.

Figure 20:
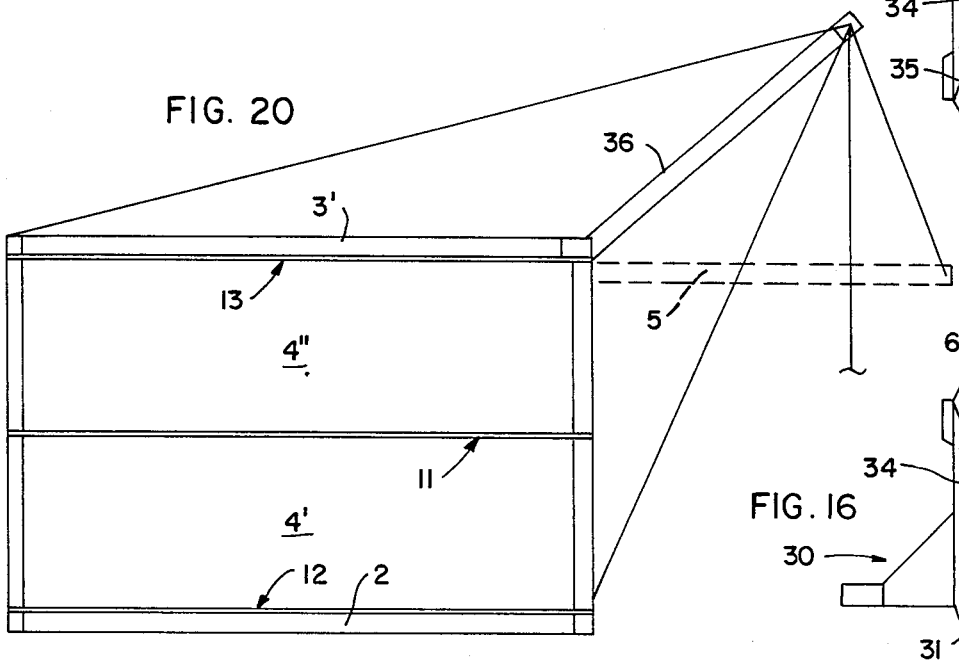
Figure 16:
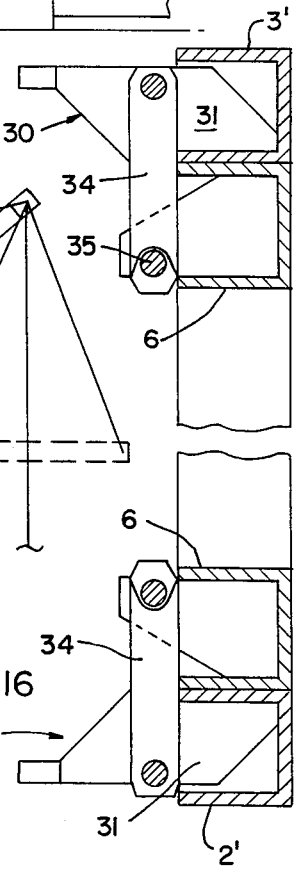
FIG. 16 is a schematic view and a section through the door member connected to the floor section and the top section of the container.

Finally, FIG. 20 is a schematic view of a beam which can be adapted to the container for lifting the same and for retracting the door member with a minimum of force applied.

In all the figures equal reference numbers refer to equal or equivalent elements and components.

Figure 5:
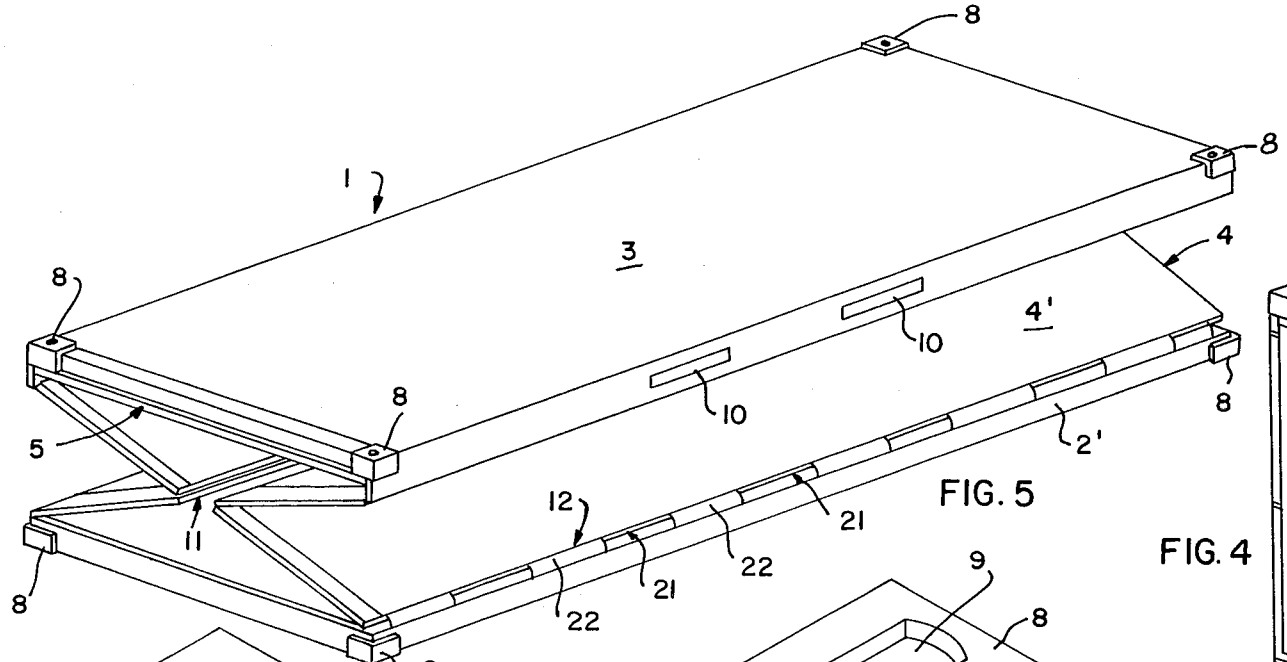
FIG. 5 shows the container at the moment of being unfolded or folded for assembly.

In the figures, the container of the present invention is generally denoted by 1 and is shown in FIGS. 1–4 in the assembled state and in FIG. 5 in the partially collapsed state.

Container 1 is of the usual box-like prismatic shape and comprises a floor section and base 2, a top section 3, both of rectangular shape, sidewalls 4, and end walls or door members 5.

The door members or end walls 5 comprise in conventional fashion a profiled frame 6. One of the door members 5 is provided with door panels 7 hinged at the edges of the frame 6 and adapted to be pivoted toward the outside of the container 1 to allow access to the cargo.

The other rear end wall 5 is of identical shape but is provided with a rigid panel in place of door member 6, with the panel affixed to a corresponding frame portion. Both base 2 and top 3 are in the usual manner formed by respective profiled frames 2′ and 3′ with prismatic corner brackets 8 provided with slots 9 for inserting support means used in hoisting container 1.

Corner brackets 8 of floor 2 and top 3 are connected through transverse beams integral with the frame so that coplanar surfaces are formed in the upper part of container 1 in the region of corner brackets 8. With this configuration, another container can be stacked on top.

Figures 2, 3, 15:
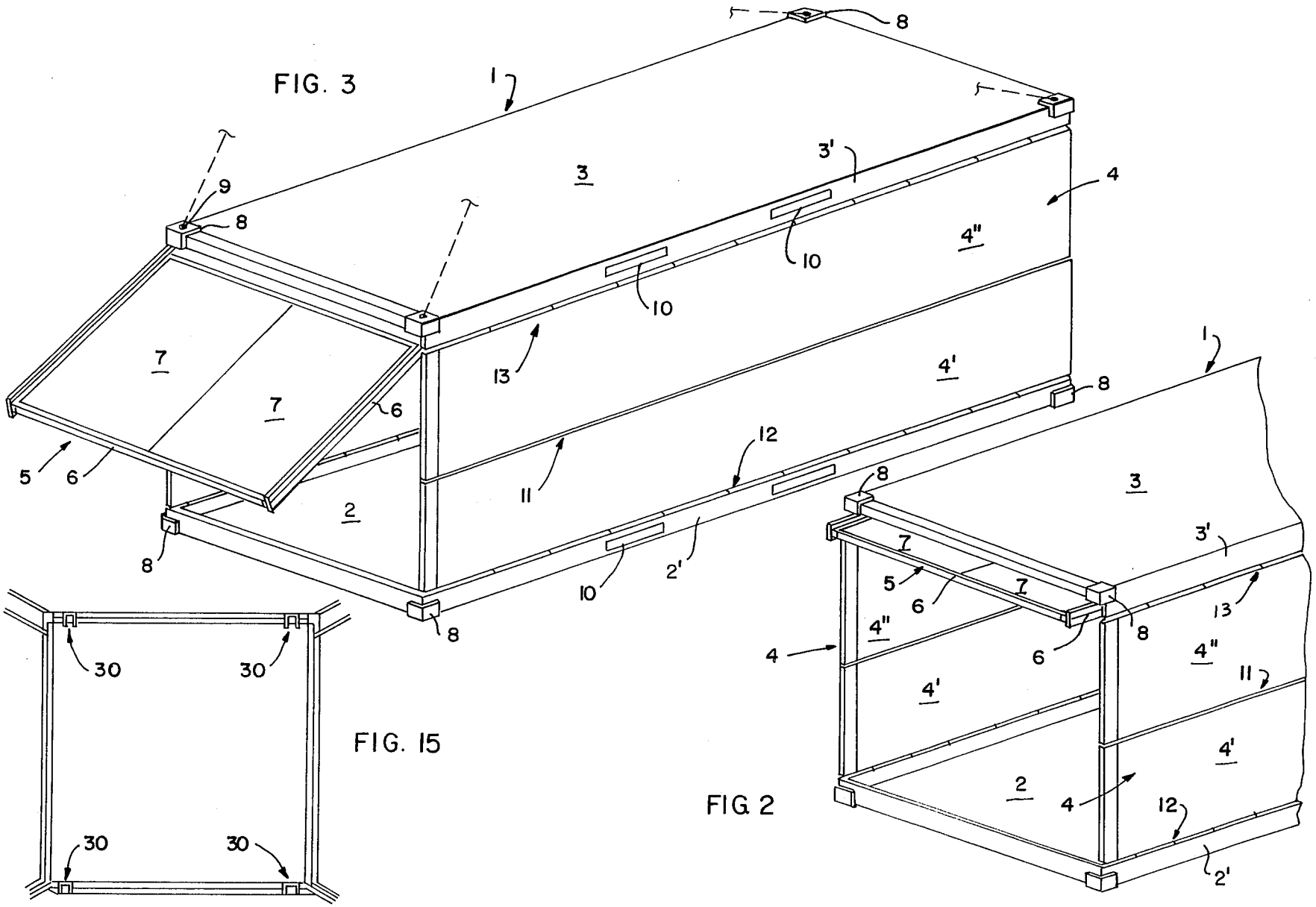
FIG. 2 is a partial perspective view of the container with the door member partially moved toward the outside.
FIG. 3 is a perspective view resembling FIGS. 1 and 2 and shows the door member in the retracted position used for both the assembly and the folding of the container.
FIG. 15 is a schematic perspective view illustrating the positioning of the locking means of the door member.
Figure 4:
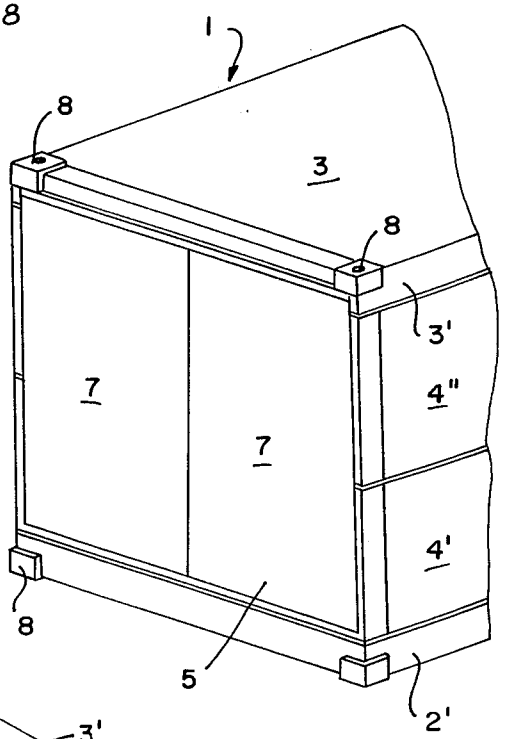
FIG. 4 is a partial view of the container in the assembled state, with the door member acting as a reinforcing frame and with the hinge means of the sidewalls inserted in the floor section and the top section of the container.

As shown in FIGS. 1 and 3, top 3 and base 2 may comprise a pair of profile slots 10 disposed transverse to container 1 to allow the insertion of the claws of a crane used in the handling of container 1.

As usual in the design of collapsible containers of the type to which the present invention refers, the sidewalls 4 of container 1 are provided with a longitudinal central fold line formed by hinge 11 of the "piano type." The hinge line delimits in each of sidewalls 4 panels 4′ and 4″ which, in turn, are connected through corresponding longitudinal hinges 12 and 13 to floor 2 and top section 3, respectively.

FIGS. 9–11 illustrate the characteristic design features of the sidewalls 4 and, more specifically, of panels 4′ and 4″.

It can be inferred from the figures that upper panel 4″, which is hinged to top section 3, comprises an upper longitudinal U-shaped profile section 14 the legs 14′ of which point toward top section 3 which, in turn, is provided with a U-shaped profile section 15 facing profile section 14 and having greater width than profile section 14 of panel 4″. The difference in width is approximately equal to the thickness of the legs of profile sections 14 and 15.

Profile section 15 has an outer leg 15′ of a length exceeding that of inner leg 15″ of the U-shaped profile section 15.

The lower longitudinal profile section 16 of panel 4″ corresponds to the central hinge line of sidewall 4 and is also U-shaped. The legs point toward the lower profile 17 associated with lower panel 4″ of sidewall 4. As in the case of upper profile sections 14 and 15, the widths of the profiles are different.

Profiles 16 and 17 of the hinge line of sidewall 4 are pivotable by means of a "piano type" hinge member 11. In the assembled state of container 1, the inner legs 16′ and 17′ overlap and, together with partitions 18, form a tight closure in the particular area.

Lower profile 19 of panel 4′ of sidewall 4 has the same characteristics and its outer leg 19′ of greater length overlaps leg 20′ of a U-shaped edge portion 20 of base 2.

Profiles 14, 15 and 19, 20 of the sidewall, top section 3, and base 2 are joined through hinges 12 and 13 which are shown in detail in FIGS. 6–8.

Hinges 12 and 13 joining panels 4′ and 4″ with base 2 and top 3 are an important characteristic feature of the invention and are of identical design and structure.

Each of hinges 12 and 13 is formed by a pair of a set of U-shaped plates 21 and 22 with opposing parallel legs 21′ and 22′. Plates 21 of one of the sets are oppositely directed to plates 22 of the other set and plates 21 and 22 alternate with respect to hinge shaft 23.

As shown in FIG. 6–11, plates 21 and 22, which connect upper panel 4″ to top section 3, have their legs 21′ and 22′ affixed to legs 15′ and 15″ and 14′ of profiles 15 and 14, with the center sections 21″ and 22″ of plates 21 and 22 protruding.

Plates 22 of hinges 12 and 13 are uniformly spaced by a distance slightly in excess of the width of each of the plates. Plates 22 are mounted on shaft 23 which extends across plates 21.

Hinges 12 and 13 are fixedly attached between profiles 14 and 15 of top section 3 and profile 19 and edge portion 20 of the base, respectively; the curved center portion of each of the plates is pressed against hinge shaft 23 in each of hinges 12 and 13.

Plates 21 of hinges 12 and 13 therefore can move freely with respect to shaft 23.

This feature is very important because hinges 12 and 13 allow relative movement between sidewalls 4, top section 3, and base 2, as can be inferred from FIGS. 7 and 9. As shown in FIGS. 8–10, at the same time a connection between these elements exists since center portions 21'' and 22'' of plates 21 and 22 enter into the legs of profiles 14 and 15 or profiles 19 and 20 to form an enclosure of sidewalls 4 in the top section 3 and with the base 2 (see FIGS. 8 and 10).

Thus, when container 1 is in the assembled state, sidewalls 4 are connected to base 2 and top section 3, and legs 15' and 19' of greater length, profile sections 15 of top 3, and lower profile 19 of panel 4'' form sealing means through the overlapping of the legs of profile section 14 of panel 4'' and of edge portion 20 of base 2.

Door members 5 are journaled on corresponding pivot pins 24 coaxially arranged on opposite sides of top section 3 and above profile 15. Door members 15 are provided with frames 6 of a particular shape, with the frames provided with sliding surfaces 25 in profile 28 to allow movement on pivot pins 24. Sliding surfaces 25 are delimited by stop members 26 for the doors.

Door members 5 therefore can swing on pivot pins 24 provided at their ends with means for rolling, such as wheels 27 housed in the interior of profiled member 28 which is integral with frame 6 of door member 5. The door members are slidingly supported on the wheels to obtain the collapsed state of container 1 when the door members are in the upper part of top section 3 which for this purpose has cavity 28 above pivot pins 24.

FIGS. 17–19 illustrate another embodiment of the door member 5 which can swing around coaxial pivot pins 29' extending from the inner surfaces on opposite sides of the top section and, which by contrast to the preceding embodiment, allow pivoting movement of the door members 5 toward the container inside and the top section 3 where the door members may be retained by conventional means (not shown).

In the assembled state of the container, door members 5 act as reinforcing plates and render added strength to the container when other containers are stacked on top.

Lest the container be unlocked and leave the assembled state when hoisted on the top section 3, both embodiments of door members 5 comprise locking means 30 mounted between the frames of top section 3 and base 2.

Figure 14:
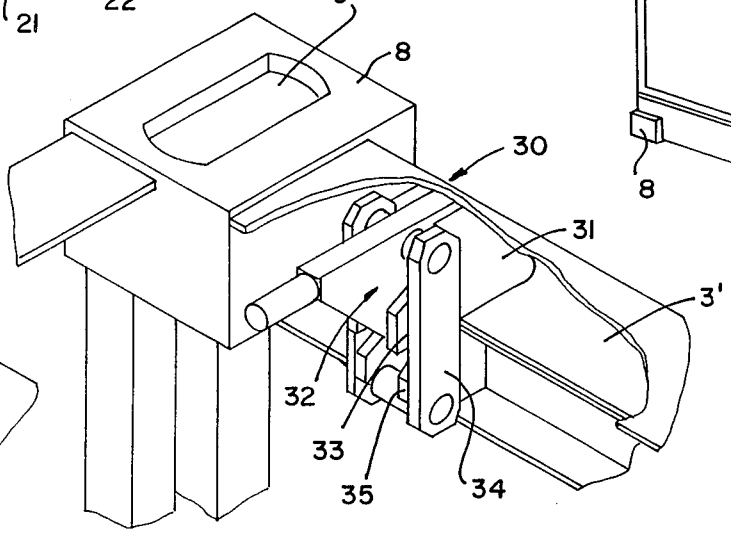
FIGS. 13 and 14 are perspective views of means locking the door members in the floor section and the top section.
Figure 13:
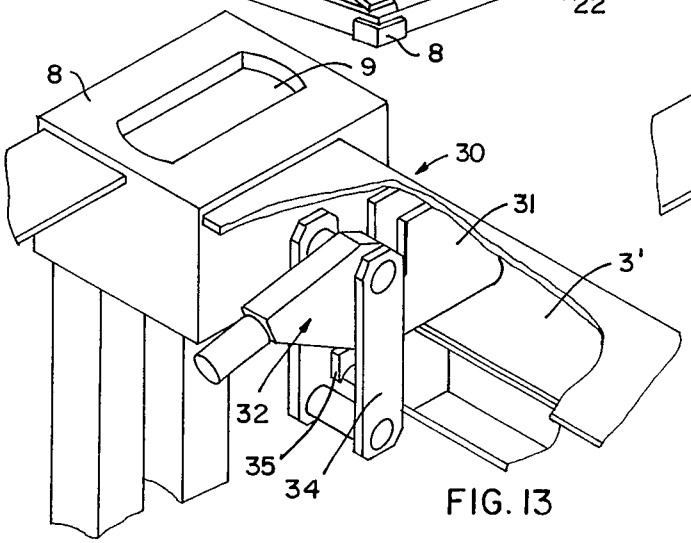

As shown in FIGS. 13–15, the locking means comprise a member 31 attached to frame 3' of top section 3 or the frame of base 2, a lever 32 rotatable on a shaft 33, and a fork member 34 rotatably connected to lever 32 and adapted to be retained by tooth 35 fastened to frame 6 of door member 5.

Locking means 30 are actuated by levers 32 and, in the working position, exert increasing pressure when the stress forces exerted upon them are increased. In this way the structural strength, stability, and rigidity of the container are increased.

The locking means 30 absorb traction forces to which the container 1 is subjected during its use because hinges 12 and 13 cannot transmit traction forces.

It follows from the above description that for assembling or for collapsing container 1, the top section 3 is lifted and suspended by corner brackets 8 so that, when hinges 12 and 13 connecting panels 4' and 4'' with base 2 and top 3 are lifted, the position shown in FIG. 7 is assumed.

After that, door members 5 are pulled out of their housing in the case of the first embodiment or are pivoted in the case of the second embodiment shown in FIGS. 17–19.

The door members are manipulated with the aid of a beam 36 shown in FIG. 20. For this purpose container 1 is provided with means for attaching beam 36 by which, in the first embodiment, door member 5 is moved over the sliding surfaces 25 on pivot pins 29 until the door members have reached the horizontal position and can be accommodated in the top section.

In this state of the container, door members 5 are in a vertical position and, when container 1 is to be assembled, top section 3 is lowered so that hinges 12 and 13 get locked in the profiles as shown in FIG. 8, whereby sidewalls 4 are fixed with respect to top section 3 and base 2. Then door member 5 acts as a reinforcing frame and top section 3 and base 2 are firmly joined with the door member with the aid of locking means 30.

In addition, base 2 and top 3 can be connected to the sidewalls by locking means (not shown) to increase the rigidity of the structure.

In order to collapse the container, locking means 30 are unlocked when top section 3 is lifted again, whereby hinges 12 and 13 are released from the profiles. The beam shown in FIG. 20 is used to lift door members 5 which slide freely on pivot pins 29.

Once this state has been reached, sidewalls 4 can be folded along hinge line 11 to obtain the folded state shown in FIG. 5.

Cranes or equivalent mechanism hoisting top section 3 from corner brackets 8 can be used to unlock hinges 12 and 13.

When no crane bridge is available, a simple crane with gripping claws or tines inserted into profile slots 10 of top section 3 can be employed for the same operation.

The flaps of hinges 12 and 13 provide sealing, as shown in FIGS. 8 and 10 and, as far as the door members are concerned, locking means 30 improve the sealing action.

Even when used without rubber seals, the sealing of container 1 can be improved by introducing appropriate sealing joints.

The above description has clearly established the advantages provided by the invention which need not be explained in greater detail to those skilled in the art.

Obviously, various design modifications and differing components can be introduced within the scope of the present invention which is fully defined by the appended claims.

I claim:

1. Improvements on collapsible containers comprising a box-like prismatic structure formed by a floor section, a top section, a pair of sidewalls connected by hinge means to said floor section and said top section, respectively, along a central hinge line to define portions of equal surface area in said sidewalls adapted to be folded upon themselves and toward the interior of the container, with the ends of the structure closed by respective door members or end portions pivotably mounted and adapted to be folded backward toward the interior of the container, with said top section and said floor section comprising a profiled frame with generally prismatic corner brackets which form engaging means used in hoisting the container, and with the container walls provided with cooperating locking members to keep the walls rigidly connected in the assembled position of the container, characterized in that said door members or end portions are mounted so that they can pivot or swivel toward the top section of the structure on coaxially disposed pivot pins extending from opposite sides of said top section, that the hinge members of the sidewalls engaging the floor section and the top section, respectively, are formed by a pair of sets of U-shaped oppositely oriented plates, that the legs of the plates of one of the sets are integral with the hinge means rigidly connected to the legs of a U-shaped profile forming part of the sidewalls, whereas the legs of the plates of the other set are connected to the legs of a U-shaped profile forming an integral part of said top section, that a set of U-shaped plates of said hinge means is rigidly joined with a hinge line extending across the U-shaped plates of the other set and adapted to move freely with respect to said hinge line, that the intermediate portions of said U-shaped plate form an enclosure of the hinge means in said U-shaped profiles integral with the respective sidewall and the top section in the assembled state of the container, that the plates of the two sets remain connected and pivotable around said axis in a second, collapsed state of the container, and that the frames forming the top section and the floor section are provided with supports for connecting corresponding protruding locking means extending from the frames of said sidewalls and from the door members or end portions of the container.

2. Improvements according to claim 1, characterized in that said door members or end portions are journaled in said pivot pins provided at the ends with corresponding rolling members to slidingly support said door members, that said rolling members are formed by wheels mounted inside said lateral profiles forming the frame of said door members, that the latter are provided along said profile with a sliding surface along which the fixed pivot pin on the top section is disposed, and that said door member upon being lifted, remains slidingly supported on said wheels of said pivot pins to be accommodated under said top section.

3. Improvements according to claim 1, characterized in that said door members are rotatably mounted on pivot pins located under said top section and on opposite sides thereof, that said door member is provided with a U-shaped profiled frame to support a detent integral with the frame of the sidewall, of the floor section, and of the end portion of the container, and that said door member is provided with means establishing a connection to means of traction, said means being adapted to produce the withdrawal of the door member toward the interior and toward the top section of the container.

4. Improvements according to claim 1, characterized in that to obtain connection of the set of U-shaped plates with the sidewalls and the floor/top sections, one of the U-shaped profiles has a width exceeding the width of the complementary profile and a leg defining a detent covering the other profile to obtain a tight seal.

5. Improvements according to claim 1, characterized in that each of said sidewalls in its central hinge line comprises longitudinal profiles one of which has a greater width than the other and a flap covering the complementary profile to form a tight seal.

6. Improvements according to claim 1, characterized in that said door members are provided with pins for attaching lever arms and tensioning means used for lifting said door members.

7. Improvements according to claim 1, characterized in that said supports connecting the locking members are fixedly mounted on the profiled frames of the top section and the base of the container and comprise a pivotable lever integral with a fork member forming a locking means of a single protrusion connected to the profile of said door members and sidewalls.

* * * * *